US006701534B2

(12) United States Patent
Guibord

(10) Patent No.: US 6,701,534 B2
(45) Date of Patent: Mar. 9, 2004

(54) WORK TOOL BELT DEVICE

(76) Inventor: Michel Daniel Guibord, 13774 Terrien, Mirabel, QBC (CA), J7J 1L4

( * ) Notice: Subject to any disclaimer, the term of this patent is extended or adjusted under 35 U.S.C. 154(b) by 244 days.

(21) Appl. No.: 10/020,245

(22) Filed: Dec. 18, 2001

(65) Prior Publication Data

US 2003/0110550 A1 Jun. 19, 2003

(51) Int. Cl.[7] ..... A41F 15/00
(52) U.S. Cl. ..... 2/338; 224/904
(58) Field of Search ..... 2/312, 69, 310–311, 2/338, 314–322, 336, 326, 327; 224/673, 232, 678, 680, 251, 197, 242, 904; 128/99.1, 100.1, 101.1, 102.1; 182/3–5

(56) References Cited

U.S. PATENT DOCUMENTS

| | | | | | |
|---|---|---|---|---|---|
| 4,174,793 | A | | 11/1979 | Wisowaty | |
| 4,348,774 | A | * | 9/1982 | Woodson | 2/338 |
| 4,622,957 | A | * | 11/1986 | Curlee | 602/13 |
| 4,974,764 | A | | 12/1990 | Cantwell | |
| 5,172,429 | A | | 12/1992 | Lucier | |
| 5,201,448 | A | | 4/1993 | Schue | |
| 5,349,706 | A | | 9/1994 | Keer | |
| 5,441,185 | A | | 8/1995 | Dragos | |
| 5,445,303 | A | | 8/1995 | Cawile, Jr. | |
| 5,497,923 | A | | 3/1996 | Pearson et al. | |
| 5,505,356 | A | | 4/1996 | Noriega et al. | |
| 6,041,444 | A | * | 3/2000 | McKinney | 2/310 |
| 6,163,890 | A | | 12/2000 | Utamaru | |
| 6,193,122 | B1 | * | 2/2001 | Buckley | 224/270 |

* cited by examiner

*Primary Examiner*—Tejash Patel

(57) ABSTRACT

A work tool belt device includes an elongated strap for mounting on a user's waist and for carrying a plurality of tools thereon. The strap has opposed free ends that carry complementary parts of a locking member for securing the device around a user's waist. An elongated hip rest is secured to an internal surface of the strap to resiliently and uniformly distribute the carried weight of the tools along the hips of the user. The hip rest defines a plurality of transversal through channels spaced equidistant apart there along on a user side surface facing away from the strap to form a plurality of support sections. A plurality of tool holders are mounted along an external surface of the strap to releasably receive complementary hook members of the tools therein.

20 Claims, 3 Drawing Sheets

WORK TOOL BELT DEVICE

FIELD OF THE INVENTION

The present invention is directed to work tool belt devices for mounting on a user's waist for carrying a plurality of tools thereon, and more particularly to a work tool belt device resiliently and uniformly distributing the weight carried by the device along the hips of the user.

BACKGROUND OF THE INVENTION

People using known work tool belt devices from the prior art mounted on their waists for carrying a plurality of tools may experience difficulties with the capacity of the devices to efficiently assume their hips. As a result users very often have lumbar and hip pains.

U.S. Pat. No. 5,201,448 issued to Schue on Apr. 13, 1993 discloses a utility belt in which the mid portion, used as a back support, has a large width compared to the side portions. This device cannot resiliently distribute the carried weight along the hips of the user.

U.S. Pat. No. 5,349,706 issued to Keer on Sep. 27, 1994 discloses a working belt with lumbar support that can include a fluid inflated element. This device is very complicated, unproductive and cannot assume user's hips.

SUMMARY OF THE INVENTION

It is therefore a general object of the present invention to provide a work tool belt device that obviates the above mentioned disadvantages.

An advantage of the present invention is that the work tool belt device assumes the hips of the user.

A further advantage of the present invention is that the work tool belt device is easy to fit around a user's waist.

Still another advantage of the present invention is that the work tool belt device allows for tools to be mounted thereon using a standard holder.

Still a further and even more important advantage of the present invention is that the work tool belt device resiliently and uniformly distributes the weight carried by the device along the hips of the user.

Another advantage of the present invention is that the work tool belt device includes tool holders that are preferably releasably mounted on suspenders an that can pivot about their mounting fastener.

The present invention is directed to a work tool belt device that comprises:

an elongated strap for carrying a plurality of tools thereon, the strap defining a strap internal surface and an opposed strap external surface, the strap having opposed free ends carrying complementary parts of a locking member for securing the device around a user's waist;

at least one elongated hip rest secured to the strap internal surface for resiliently and uniformly distributing a carried weight of the tools along the hips of the user, the hip rest defining a plurality of transversal through channels spaced equidistant apart therealong on a hip rest user side surface facing away from the strap to form a plurality of support sections, whereby the channels allowing for adjacent support sections to fold inwardly toward each other for the device to assume the waist of the user; and tool holders mounted along the strap external surface, the holders for releasably receiving complementary hook members of the tools therein.

Preferably, the strap includes first and second elongated strap sections connecting to each other to longitudinally extend from each other, each of the strap sections carrying a respective hip rest section of the hip rest secured to the strap internal surface, a first end of each of the strap sections carrying the complementary parts of the locking member and a second end of each of the strap sections carrying complementary parts of an adjusting member to longitudinally size the strap for fitting the user's waist.

Preferably, each of the support sections of the hip rest has transversal corrugations on the hip rest user side surface to increase resiliency of the hip rest, the corrugations being generally parallel to the channels.

Preferably, the strap internal surface and a hip rest external surface carrying complementary parts of a fastening member to releasably and adjustably secure the hip rest to the strap.

Preferably, the device includes at least one tool adapter for releasably receiving the tools thereon and having a complementary hook member releasably engaging one of the tool holders of the device.

Preferably, the tool adapter including a pocket for receiving implements therein, the pocket having a back side carrying the complementary hook member and a front side connecting to the back side along respective lateral and bottom edges to form the pocket.

Preferably, the front side of the pocket includes a top edge having a rigid stem to keep the top edge away from the back side, thereby keeping the pocket in open configuration.

Preferably, the device includes suspenders adjustably securing to the strap for partial distribution of the carried weight on shoulders of the user.

Preferably, the tool holders are formed by an elongated semi-rigid member having a plurality of attachment regions securing along the strap and spaced equidistant apart from each other, and a plurality of free regions, each of the free regions being between two adjacent of the attachment regions for releasably receiving complementary hook members of the tools thereon.

Preferably, the tool holders are pivotally mounted on the strap.

Preferably, each of the tool holders has a central section frictionally rubbing on the strap and a pair of wings extending outwardly from the central section in opposite directions along the strap; whereby the wings defining narrow gaps with the strap external surface to be releasably engaged by the complementary hook members of one of the tools.

Preferably, the device includes a holder support releasably secured to the suspenders, the holder support carrying one of the tool holders thereon.

Preferably, the tool holder is pivotally mounted on the holder support.

Other objects and advantages of the present invention will become apparent from a careful reading of the detailed description provided herein, within appropriate reference to the accompanying drawings.

BRIEF DESCRIPTION OF THE DRAWINGS

In the annexed drawings, like reference characters indicate like elements throughout.

DETAILED DESCRIPTION OF THE PREFERRED EMBODIMENTS

With reference to the annexed drawings the preferred embodiments of the present invention will be herein described for indicative purpose and by no means as of limitation.

Figure 1:
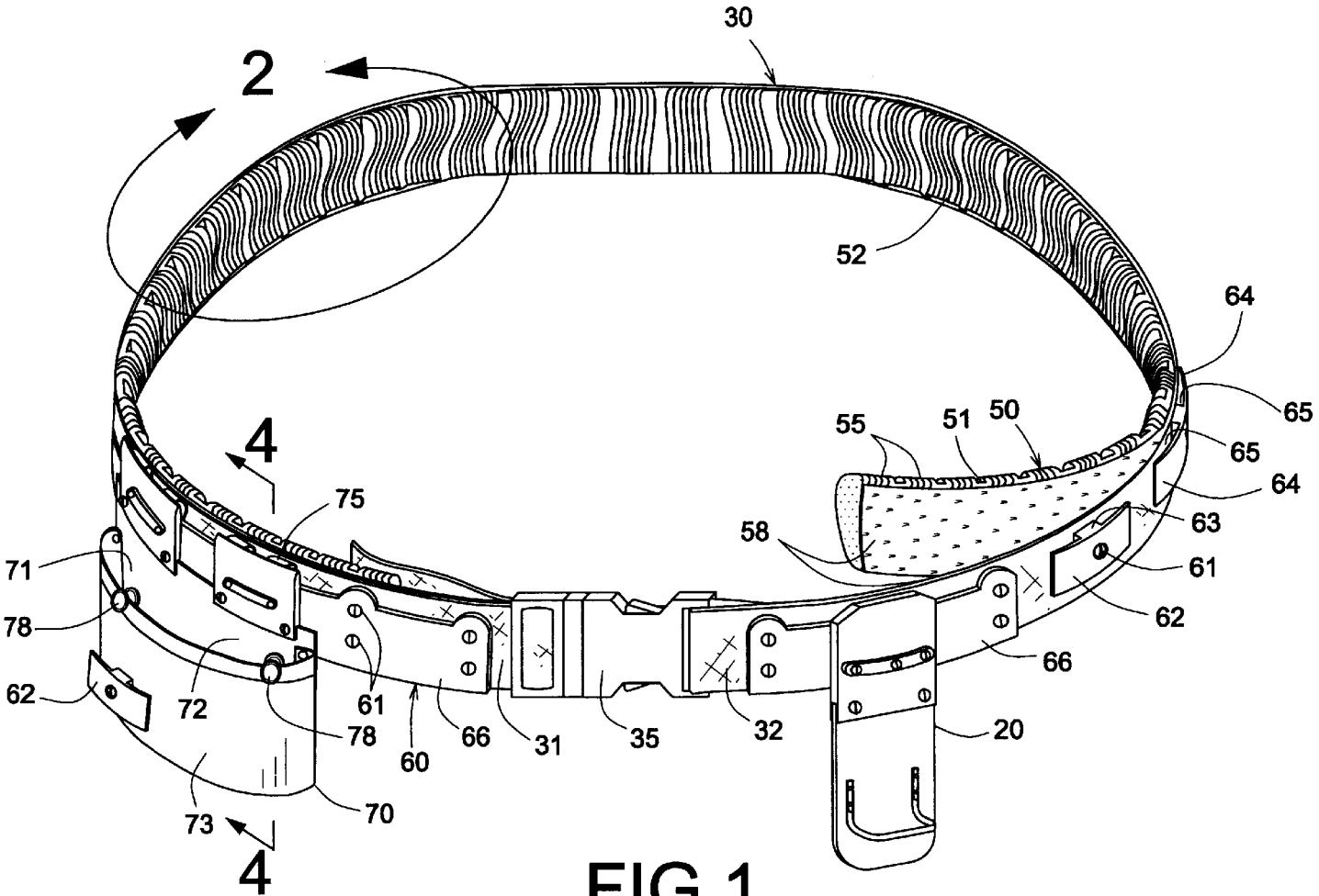
FIG. 1 is a perspective view of an embodiment of a work tool belt device according to the present invention.

Referring to FIGS. 1, there is shown an embodiment 10 of a work tool belt device according to the present invention for mounting on a user's waist and for carrying a plurality of tools 20 thereon. The device 10 includes an elongated strap 30 or the like, an elongated hip rest 50 and a plurality of tool holders 60 secured to the internal 33 and external 34 surfaces of the strap 30, respectively.

The strap 30 has opposed free ends 31 and 32 carrying complementary parts of a locking member 35 to secure the device 10 around the user's waist.

The hip rest 50 is secured (see FIGS. 1 and 2) to the internal surface 33 of the strap 30 for resilient and uniform distribution of the weight carried by the device 10 along the hips of the user. The hip rest 50 defines a plurality of transversal through channels 51 spaced equidistant apart along the hip rest 50 on a user side surface 52 facing away from the strap 30 to form a plurality of small support sections 55 and allow for these support sections 55 to fold inwardly toward each other to enable the device 10 to properly assume the waist of the user (see FIG. 2).

The holders 60 preferably secured to the strap 30 via fasteners such as bolts 61, rivets 61*a* or the like, are adapted to releasably receive complementary hook members 25 of the tools 20 therein, thus carrying a plurality of tools 20 on the device 10.

The tool holders 60 are preferably individual holders 62 with a central section 63 secured to the strap 30 and a pair of wings 64 extending outwardly from the central section 63 in opposite directions along the strap 30. The wings 64 define, with the strap external surface 34, narrow gaps 65 that are releasably engaged by a pair of complementary hooks 25 of one of the tools 20.

The holders 62 are preferably pivotally mounted on the strap 30 with their central section 63 frictionally rubbing against the same 30.

Figure 2:
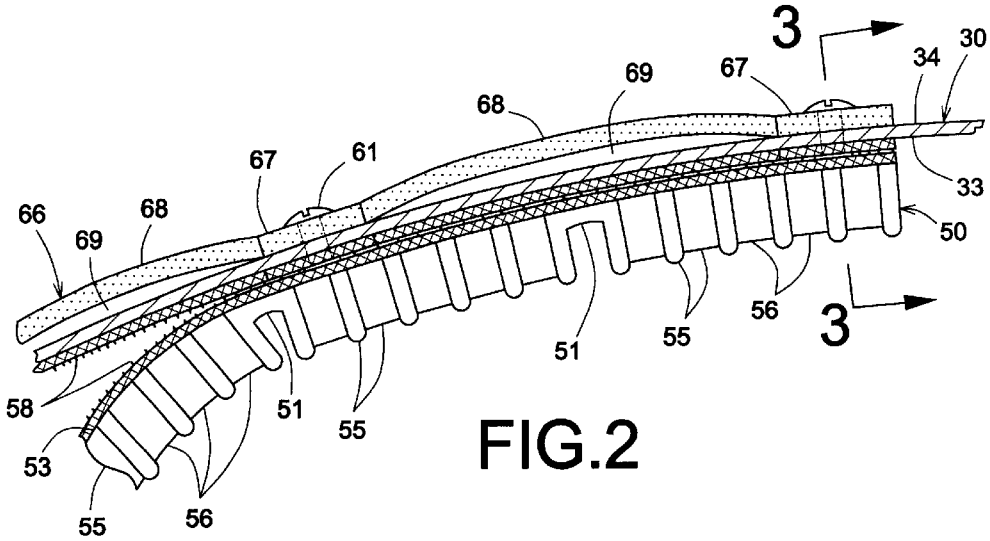
FIG. 2 is an enlarged partial top view taken along line 2 of FIG. 1, showing the hip rest partially unattached to the structure of the embodiment.

Also, some holders 60 are formed by an elongated semi-rigid member 66 with a plurality of attachment regions 67 secured along the strap 30 and generally spaced equidistant apart from each other, to form a plurality of free regions 68. Each free region 68 is slightly separated from the strap 30 between two adjacent attachment regions 67 to for a gap 69 that is releasably engaged by a complementary hook 25 of one of the tools 20, as shown in FIG. 2.

Each support section 55 of the hip rest 50 (see FIG. 3) preferably has transversal corrugations 56, generally parallel to the channels 51, on the user side surface 52 for additional resiliency of the hip rest 50.

The internal surface 33 of the strap 30 and the external surface 53 of the hip rest 50 both carry complementary parts of a fastening member 58, preferably of Velcro™ type, secured thereto to releasably and adjustably secure the hip rest 50 to the strap 30.

Figure 3:
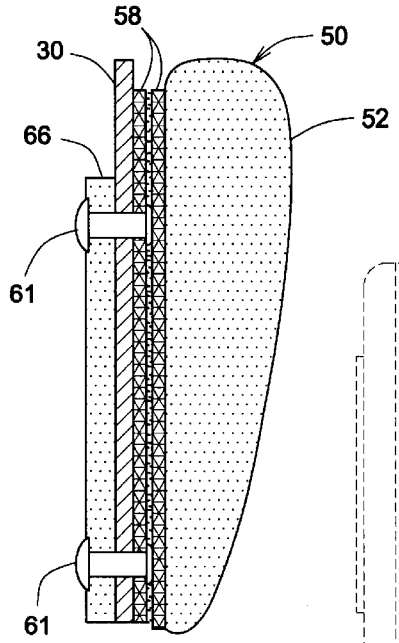
FIG. 3 is a cross-sectional view taken along line 3—3 of FIG. 2.

As illustrated on FIG. 3, the user side 52 of the hip rest 50 extends generally upwardly away from the strap 30 to improve the weight distribution on the hips of the user and efficiently assume his waist. Although not shown, the user side surface 52 of the hip rest 50 can be covered with a felt type material for better comfort.

The device 10 preferably includes at least one tool adapter 70 having a complementary hook 75 to releasably engage one of the tool holders 60 of the device 10, and adapted to releasably receive tools 20 thereon, preferably via a fastening device such as an individual holder 62 or the like, depending on the tool 20 to be secured thereto.

Figure 4:
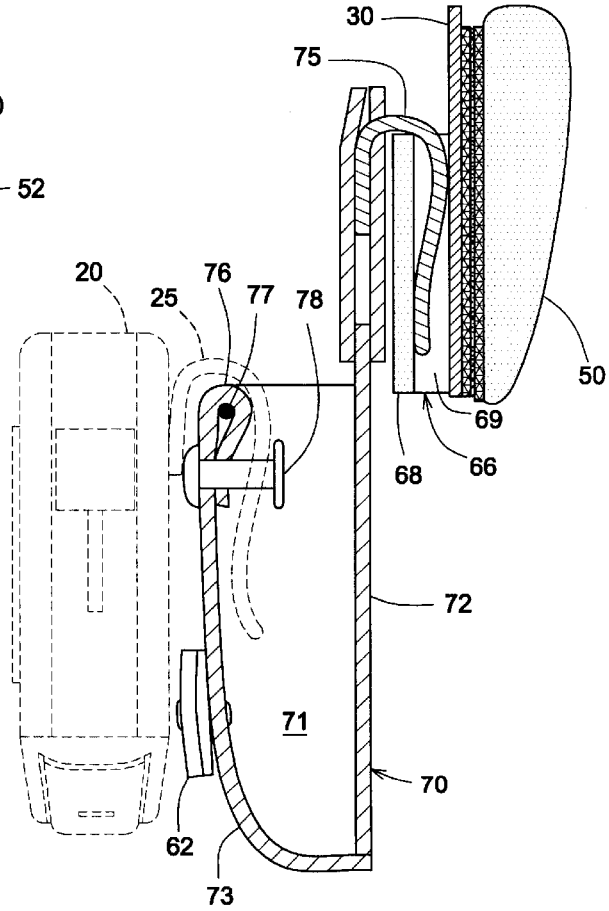
FIG. 4 is a cross-sectional view taken along line 5—5 of FIG. 1.

As illustrated in FIG. 4, the tool adapter 70 preferably includes a pocket 71 to receive implements (not shown) therein, such as nails, screws, rivets, etc. The pocket is formed by a back side 72 and a front side 73 connected to each other along their respective lateral and bottom edges. The back 72 and front 73 sides carry the hook 75 and the fastening device, respectively.

The top edge 76 of the front side 73 preferably has a rigid (or semi-rigid and malleable (flexible) stem 77 therein to keep the pocket 71 in an open configuration with the top edge 76 away from the back side 72.

The front side 73 of the pocket 71 could include at least one stopper 78 connected to its top edge 76 to allow for a complementary hook 25 of a tool 20 to overhang the same and prevent its sliding there along (see FIG. 4).

Figure 5:
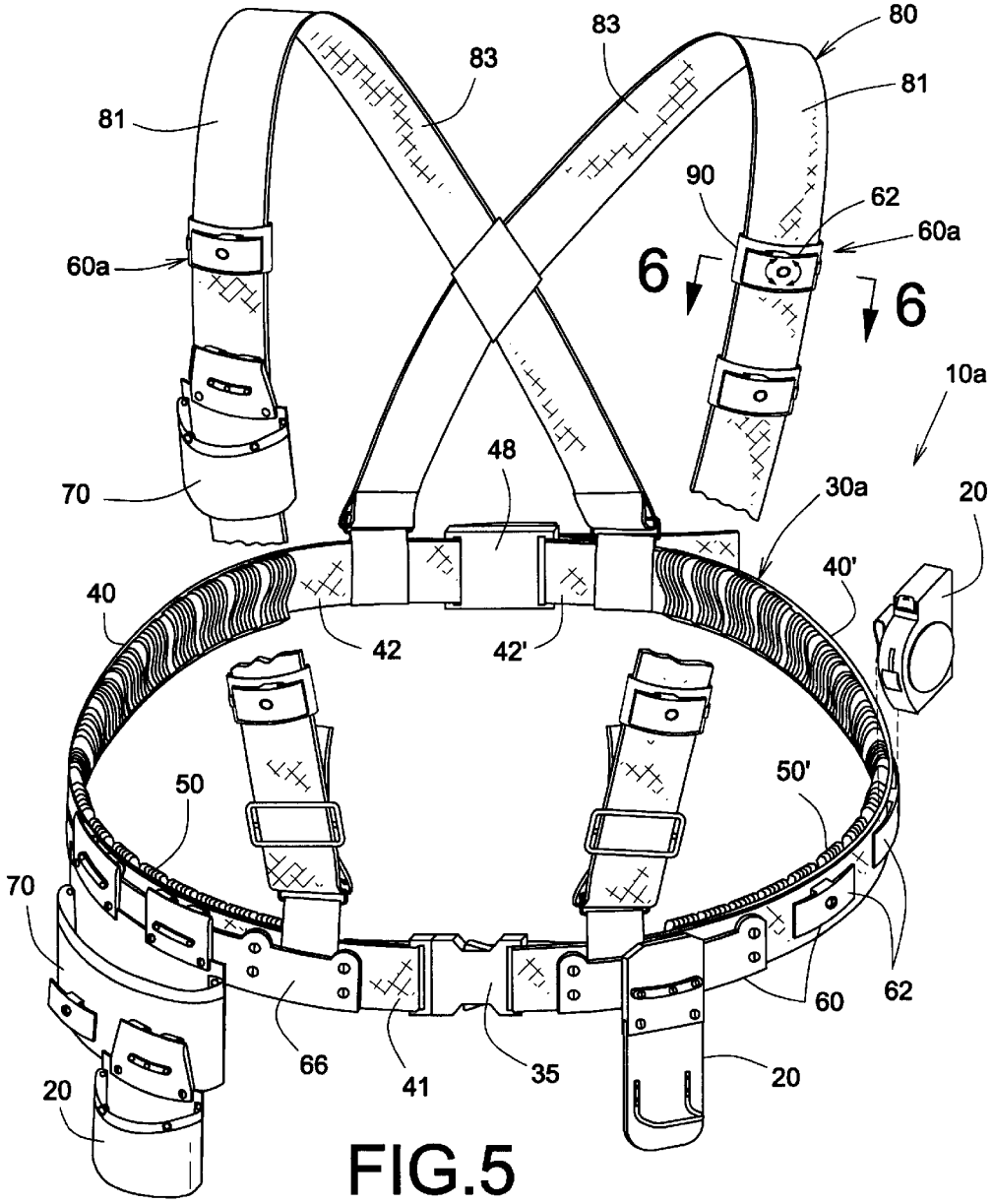
FIG. 5 is a view similar to FIG. 1, showing suspenders secured to another embodiment of the structure.

As illustrated in the FIG. 5, a second embodiment 10*a* of the device has a strap 30*a* that includes first 40 and second 40' elongated strap sections connected to each other to longitudinally extend from each other. Each section 40, 40' carries a respective section 59, 59' of the hip rest 50 secured to its internal surface 43. First free ends 41, 41' of the sections 40, 40' carry complementary parts of the locking member 35 and while the second ends 42, 42' of the sections 40, 40' carry complementary parts of an adjusting member 48 used to longitudinally size the strap 30 for fitting the user's waist.

The device 10 preferably includes suspenders 80 adjustably secured to the strap 30 to distribute a portion of the carried weight on the shoulders of the user and partially relieve the waist.

The suspenders 80 have an external surface 81 facing away from the user that preferably carries one, or more, holder(s) 62 pivotally connected thereto and that protrude outwardly therefrom to releasably receive complementary hooks 25 of tools 20 therein.

Figure 6:
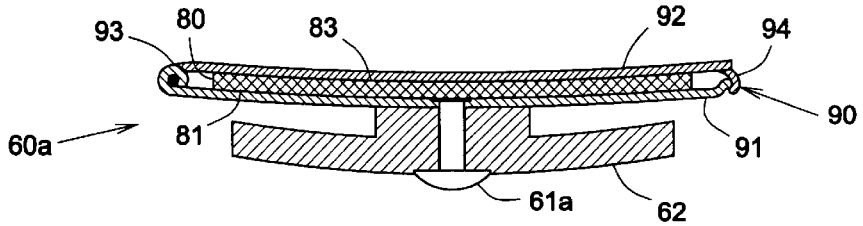
FIG. 6 is a cross-sectional view taken along line 6—6 of FIG. 5.

Referring to FIGS. 5 and 6, each one of the tool holders 60*a* mounted on the suspenders 80, as illustrated on the right hand side of FIG. 5, preferably includes a holder support 90 releasably and adjustably securing thereto. Each holder 62 pivotally connects to its support 90 via the rivet type fastener 61*a*.

The support 90 can be any type of widely known quick attaching clamp device. Preferably, the holder support 90 includes a first part 91 bearing the holder 62 and embracing the external surface 81 of the suspenders 80 and a second part 92 defining a first end 93 pivotally mounted on the first part 91 to embrace the internal surface 83 of the suspenders 80 and a second end 94 adapted to latch to the first part 91 so as to clamp or squeeze the suspenders 80 between the two parts 91, 92, as illustrated in FIG. 6. Accordingly, the second part 92 has a generally concave shape from one end 93 to the other 94.

With the present device 10 it is easy to adjust on the waist of a user depending on his work habits. Because of the resiliency of the hip rest 50 and the uniform distribution of the tool weight carried by the work belt device 10 along the hips of the user, the worker's body is less susceptible to back pain and the like, which is very important for professional workers.

The elongated belt strap 30 may be manufactured from a resistant fabric material such as canvas and formed in multiple layers using stitched seams. The materials can be leather, plastic, or the like providing a durable, flexible, and washable belt.

The hip rest 50 can be made out different resilient and spongy type materials, such as rubber, silicone and the like.

Although the present work belt device has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A work tool belt device comprising:

an elongated strap for carrying a plurality of tools thereon, said strap defining a strap internal surface and an opposed strap external surface, said strap having opposed free ends carrying complementary parts of a locking member for securing said device around a user's waist;

at least one elongated hip rest secured to said strap internal surface for resiliently and uniformly distributing a carried weight of said tools along the hips of the user, said hip rest defining a plurality of transversal through channels spaced equidistant apart therealong on a hip rest user side surface facing away from said strap to form a plurality of support sections, wherein said channels allowing for adjacent support sections to fold inwardly toward each other for said device to assume the waist of the user; and tool holders mounted along said strap external surface, said holders for releasably receiving complementary hook members of said tools therein.

2. The device of claim 1, wherein said strap including first and second elongated strap sections connecting to each other to longitudinally extend from each other, each of said strap sections carrying a respective hip rest section of said hip rest secured to said strap internal surface, a first end of each of said strap sections carrying said complementary parts of said locking member and a second end of each of said strap sections carrying complementary parts of an adjusting member to longitudinally size said strap for fitting the user's waist.

3. The device of claim 1, wherein each of said support sections of said hip rest having transversal corrugations on said hip rest user side surface to increase resiliency of said hip rest, said corrugations being generally parallel to said channels.

4. The device of claim 1, wherein said strap internal surface and a hip rest external surface carrying complementary parts of a fastening member to releasably and adjustably secure said hip rest to said strap.

5. The device of claim 1, wherein said hip rest user side surface extending generally upwardly away from said strap; whereby said hip rest improving weight distribution on hips of the user.

6. The device of claim 1, including at least one tool adapter for releasably receiving said tools thereon and having a complementary hook member releasably engaging one of said tool holders of said device.

7. The device of claim 6, wherein said tool adapter including a pocket for receiving implements therein, said pocket having a back side carrying said complementary hook member and a front side connecting to said back side along respective lateral and bottom edges to form said pocket.

8. The device of claim 7, wherein said front side of said pocket including a top edge having a rigid stem to keep said top edge away from said back side, thereby keeping said pocket in open configuration.

9. The device of claim 7, wherein said pocket including at least one stopper connecting to said top edge of said front side for preventing a complementary hook member of a tool from sliding along said top edge.

10. The device of claim 7, wherein said tool adapter including at least one of said tool holders mounted on an external surface of said front side of said pocket, said tool holder is adapted for releasably receiving complementary hook members of said tools therein.

11. The device of claim 10, wherein said tool holder of said tool adapter being pivotally mounted on said front side of said pocket.

12. The device of claim 11, wherein said tool holder of said tool adapter having a central section frictionally rubbing on said front side and a pair of wings extending outwardly and laterally from said central section in opposite directions along said front side of said pocket; whereby said wings defining narrow gaps with said front side of said pocket to be releasably engaged by said complementary hook members of one of said tools.

13. The device of claim 1, including suspenders adjustably securing to said strap for partial distribution of said carried weight on shoulders of the user.

14. The device of claim 1, wherein said hip rest being made out of a resilient and spongy type material.

15. The device of claim 1, wherein said tool holders being formed by an elongated semi-rigid member having a plurality of attachment regions securing along said strap and spaced equidistant apart from each other, and a plurality of free regions, each of said free regions being between two adjacent of said attachment regions for releasably receiving complementary hook members of said tools thereon.

16. The device of claim 1, wherein said tool holders being pivotally mounted on said strap.

17. The device of claim 16, wherein each of said tool holders having a central section frictionally rubbing on said strap and a pair of wings extending outwardly from said central section in opposite directions along said strap; whereby said wings defining narrow gaps with said strap external surface to be releasably engaged by said complementary hook members of one of said tools.

18. The device of claim 13, wherein said suspenders defining a suspenders external surface facing away from the user, said suspenders including at least one tool holder pivotally connecting thereto and protruding outwardly from said suspenders external surface for releasably receiving complementary hook members of said tools therein.

19. The device of claim 13, including a holder support releasably secured to said suspenders, said holder support carrying one of said tool holders thereon.

20. The device of claim 19, wherein said tool holder being pivotally mounted on said holder support.

* * * * *